United States Patent [19]

Pollacek et al.

[11] Patent Number: 5,040,002

[45] Date of Patent: Aug. 13, 1991

[54] REGULATOR FOR INK-JET PENS

[75] Inventors: James E. Pollacek; Niels J. Nielsen, both of Corvallis, Oreg.

[73] Assignee: Hewlett-Packard Company, Palo Alto, Calif.

[21] Appl. No.: 494,710

[22] Filed: Mar. 16, 1990

[51] Int. Cl.[5] ..... B41J 2/175

[52] U.S. Cl. ..... 346/140 R; 137/526; 251/65

[58] Field of Search ..... 346/140; 251/65; 137/526, 907, 855

[56] References Cited

U.S. PATENT DOCUMENTS

| | | | |
|---|---|---|---|
| 3,026,903 | 3/1962 | Roach | 251/65 X |
| 3,296,624 | 1/1967 | Ascoli . | |
| 3,495,620 | 2/1970 | Raimondi | 251/65 X |
| 3,905,391 | 9/1975 | Oakes | 251/65 X |
| 4,121,222 | 10/1978 | Diebold . | |
| 4,253,489 | 3/1981 | Schleiter | 251/65 X |
| 4,412,232 | 10/1983 | Weber | 346/140 |
| 4,714,937 | 12/1987 | Kaplinsky . | |

FOREIGN PATENT DOCUMENTS

| | | |
|---|---|---|
| 92072 | 7/1981 | Japan . |
| 232872 | 12/1984 | Japan . |

*Primary Examiner*—Joseph W. Hartary

[57] ABSTRACT

A regulator (20) for an ink-jet pen (24) that has a print head (30) for expelling ink from a fluid volume includes a seat (36) mounted to a pen body (26) and having a port (42) formed through it. A valve element (38) is mounted adjacent to the seat for movement relative to the port (42). Magnetic attraction is employed for urging the seat (36) and valve element (38) together to thereby close the port (42) and permit underpressure to develop in the reservoir (22). The valve element (38) and seat (36) are configured and arranged so that when the underpressure within the reservoir (22) rises above the level that may cause failure of the ink-jet print head (30) the valve element (38) moves away from the seat (36) to permit air to enter the reservoir (22), thereby reducing the underpressure to an operable level.

29 Claims, 2 Drawing Sheets

REGULATOR FOR INK-JET PENS

TECHNICAL FIELD

This invention pertains to mechanisms for regulating the pressure within the ink reservoir of an ink-jet pen.

BACKGROUND INFORMATION

Ink-jet printing has become an established printing technique that generally involves the controlled delivery of ink drops from an ink reservoir to a printing surface.

One type of ink-jet printing, known as drop-on-demand printing, employs a pen that has a print head that is responsive to control signals for ejecting drops of ink from the ink reservoir. Drop-on-demand ink-jet pens typically use one of two mechanisms for ejecting drops: thermal bubble or piezoelectric pressure wave.

The print head of a thermal bubble type pen includes a thin-film resistor that is heated to cause sudden vaporization of a small portion of the ink. The rapid expansion of the ink vapor forces a small amount of ink through a print head orifice.

Piezoelectric pressure wave pens use a piezoelectric element that is responsive to a control signal for abruptly compressing a volume of ink in the print head to thereby produce a pressure wave that forces the ink drops through the orifice.

Although conventional drop-on-demand print heads are effective for ejecting or "pumping" ink drops from a pen reservoir, they do not include any mechanism for preventing ink from permeating through the print head when the print head is inactive. Accordingly, drop-on-demand techniques require that the fluid in the ink reservoir must be stored in a manner that provides a slight underpressure within the reservoir to prevent ink leakage from the pen whenever the print head is inactive. As used herein, the term underpressure means that the fluid pressure within the reservoir is less than the pressure of the ambient air surrounding the reservoir. A rise in underpressure means the fluid pressure in the reservoir becomes more negative relative to ambient air.

The underpressure in the reservoir must be great enough for preventing ink leakage through the print head. The underpressure, however, must not be so great that the pumping action of the print head cannot overcome the underpressure to eject ink drops.

The underpressure of an ink-jet pen reservoir changes as the print head is activated to eject drops. Specifically, the ejection of ink from the reservoir increases the reservoir underpressure. Without regulation of such underpressure increase, the ink-jet pen will eventually fail because the print head will be unable to overcome the increased underpressure to eject the ink drops.

SUMMARY OF THE INVENTION

This invention is directed to a mechanism for regulating the underpressure in the reservoir of an ink-jet pen so that the underpressure remains at or above a level that is sufficient for preventing leakage of ink from the print head. The mechanism also ensures that the underpressure will not become so great as to cause the print head to fail. The range of underpressure levels within which ink leakage is prevented and the print head remains operative will be hereafter referred to as the underpressure operating range.

The invention particularly provides a regulator that comprises a seat and associated valve element. The seat is mounted to the body of an ink-jet pen reservoir. The seat has a port formed through it. In a preferred embodiment, the seat is mounted so that the prt is in fluid communication with a vent that is formed in the reservoir body. The vent permits fluid communication between the reservoir and ambient air.

The valve element is mounted adjacent to the seat for movement relative to the seat. The valve element is arranged to move into a closed position against the seat for closing the port (hence, closing the vent) and into an open position away from the seat for opening the port (hence, opening the vent).

The valve element is urged toward the closed position by magnetic attraction between the seat and valve element. The valve element is urged away from the seat by the force of the reservoir underpressure acting on the interior surface of the valve element. The seat and valve elements are configured and arranged so that the magnetic attraction between them normally holds the valve element in the closed position for sealing the vent so that sufficient underpressure may be established within the reservoir for preventing ink leakage through the print head.

The magnetic attraction between the seat and valve element holds the valve element in the closed position until the reservoir underpressure rises (for example, as a result of ink depletion forced by the print head) to a level sufficient to overcome the force of magnetic attraction. Specifically, the regulator is designed so that as the underpressure rises to a level above the underpressure operating range, the valve element is pulled away from the seat by the force of the underpressure acting on the interior surface of the valve element. Movement of the valve element from the seat permits a volume of ambient air to enter the ink-jet reservoir. As the volume of ambient air enters the ink-jet reservoir, the underpressure within the reservoir reduces to a level within the operating range and the valve element returns to the closed position as a result of the magnetic force overcoming the force of the reduced underpressure.

The strength and shape of the magnetic field and the size of the valve element and seat port are selected so that the valve element moves to the open position at the instant the underpressure rises above the operating range. Accordingly, the present invention provides a regulator that can be adjusted for precise regulation of the reservoir underpressure.

As another aspect of this invention, the valve element is formed of magnetized material that has an intrinsic spring force. Accordingly, both magnetic force and spring force are employed for closing the valve element.

As another aspect of this invention, the valve element and seat are made of elastomeric material to ensure a tight seal when the valve element is closed against the seat.

As another aspect of this invention, the regulator includes a deformable sealing feature that surrounds the port and deforms between the seat and the valve element whenever the valve element is in the closed position. The deformed sealing feature ensures a leakproof seal around the port.

As another aspect of this invention, the magnetic force is applied by an electromagnet. Consequently, the underpressure operating range may be varied by controlling the strength of the magnetic field generated by the electromagnet.

BRIEF DESCRIPTION OF THE DRAWINGS

FIG. I is a cross-sectional view of an ink-jet pen that includes a regulator formed in accordance with this invention.

DETAILED DESCRIPTION

Figure 1:
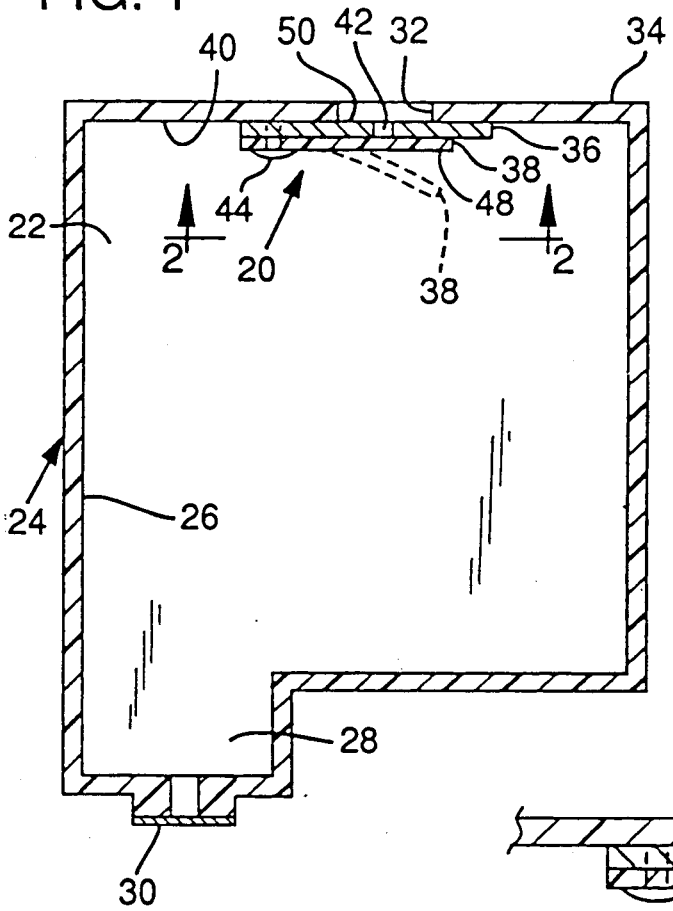
Figure 2:
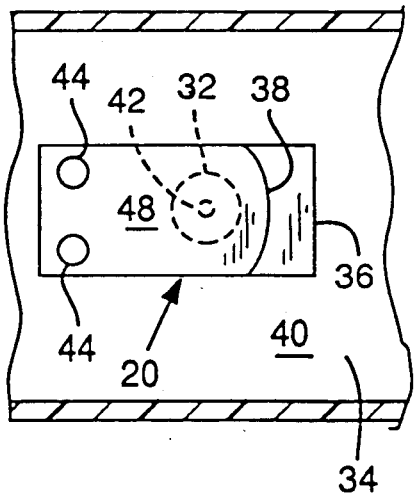
FIG. 2 is a view taken along line 2—2 of FIG. 1.

Referring to FIGS. 1 and 2, the regulator 20 of the present invention is used to control the underpressure in the reservoir 22 of an ink-jet pen 24.

The ink-jet pen 24 includes a body 26 that defines the fluid volume of the reservoir 22. The pen body 26 also defines a well 28 that is contiguous with the reservoir fluid volume. The base of the well 28 includes a conventional drop-on-demand print head 30. The print head 30 is activated by known means to expel ink from the well 28, the well being supplied with ink that is stored in the reservoir 22.

As noted earlier, conventional drop-on-demand print heads include no mechanisms for preventing ink from permeating through the print head when the print head is inactive, that is, when the print head is not being controlled to eject ink from the reservoir. Accordingly, underpressure is established within the ink-jet pen reservoir 22 for the purpose of counteracting the hydraulic pressure of the ink on the print head 30 so that the print head will not leak. Preferably, the underpressure is established at the time the reservoir 22 is filled with ink. The minimum level of underpressure necessary to prevent leakage will be a function of the configuration of the reservoir 22 and of the type of print head 30 employed. Generally, the minimum underpressure required for preventing leakage is about −2.5 cm (water column).

As the print head 30 is activated to eject ink drops, the fluid volume reduction attributable to the ejected ink causes the underpressure within the reservoir 22 to rise. Most conventional print heads 30 can continue to eject ink drops even though the underpressure rises to a level of about −10 cm (water column). Above that maximum underpressure level, however, the print head 30 will fail because it is unable to pump against so great an underpressure level. As mentioned above, the range of underpressure levels within which ink leakage is prevented and the print head 30 remains operable is referred to as the underpressure operating range.

The present invention provides a regulator 20 that prevents the reservoir underpressure from rising to a level above the underpressure operating range. The regulator 20 is mounted near a vent 32 that is formed in the top 34 of the pen body 26. The vent 32 provides fluid communication between the reservoir 22 and ambient air surrounding the pen 24. The regulator 20 generally comprises a seat 36 and a valve element 38, which are mounted to the pen body 26 near the vent 32. In one embodiment, the seat 36 is a flat strip of a ferromagnetic grade of stainless steel that is fastened to the inside surface 40 of the pen top 34. The seat 36 completely covers the vent 32. A circular port 42 is formed in the seat 36. The port 42 is in fluid communication with the vent 32 so that air may pass into the reservoir 22 through the vent 32 and port 42.

The valve element 38 is a flat, somewhat oblong member. One end of the valve element 38 is fastened, such as by fasteners 44, to the seat 36. A preferred embodiment of the valve element 38 is formed of flexible elastomeric material that has magnetic material embedded within it. Accordingly, in the absence of a counteracting force, the magnetic attraction between the valve element 38 and the seat 36 causes the valve element to move against the seat into a closed position as shown in solid lines of FIG. 1.

The valve element 36 is located so that as the valve element assumes the closed position the port 42 in the seat 36 is completely covered. Moreover, because the valve element 38 is formed of elastomeric material, the valve element compresses against the seat to thereby ensure a substantially leak-proof closure of the port 42.

It can be appreciated that the closed valve element 38 seals the reservoir 22 so that an underpressure may be established within the reservoir for the purpose of preventing leakage of ink through an inactive print head 30. As the underpressure in the reservoir 22 rises during normal operation of the print head 30, the valve element 38 remains closed until the underpressure reaches a level that exceeds the underpressure operating range (for example, −10 cm water column). As the underpressure exceeds that maximum level, the force developed by the underpressure acting upon the interior surface 48 of the valve element 38 will increase to overcome the magnetic attraction between the valve element 38 and the seat 36, and the valve element 38 will move into an open position as shown in the dashed lines of FIG. 1. For clarity, the displacement of the opened valve element 38 relative to the seat 36 is shown greatly exaggerated in FIG. 1.

With the valve element 38 in the open position, ambient air is able to move into the reservoir 22 through the vent 32 and port 42. As ambient air moves into the reservoir 22, the reservoir underpressure decreases. Consequently, the force of the underpressure acting on the valve element interior surface 48 is reduced to a level where the magnetic attraction between the valve element 38 and seat 36 once again overcomes the underpressure force to close the valve element 38.

It can be appreciated that the regulator 20 of the present invention provides a relatively simple mechanism for regulating underpressure in an ink-jet pen reservoir. Moreover, because of the compact size of the regulator 20, very little reservoir volume need be devoted to housing the regulator. Accordingly, an ink-jet pen reservoir can incorporate the regulator 20 with little reduction in the volumetric efficiency of the pen.

The regulator 20 of the present invention allows very precise adjustments so that the valve element 38 will open at any maximum underpressure level selected by the pen designer. Accordingly, the regulator is readily adaptable for use with any of a wide variety of reservoir sizes and print head performance characteristics. A number of mechanisms are available for adjusting the regulator 20 so that it opens at a selected underpressure level. (For convenience, the force required for moving the valve element 38 into the open position will be referred to as the "opening force" of the regulator.) For example, the diameter of the port 42 in the seat 36 may be changed to adjust the opening force of the regulator 20. In this regard, a larger port 42 reduces the amount of the seat area that is covered by the valve element, hence reducing the magnitude of the magnetic attraction between the valve element 38 and the seat 36. Consequently, the opening force of the regulator 20 is reduced because a lower underpressure is required for counteracting that reduced magnetic attraction.

It is noteworthy that enlarging the diameter of the port 42 in the seat 36 also exposes on the upper surface 50 of the valve element 38 a larger area against which positive ambient pressure acts, in conjunction with the underpressure, to force open the valve element 38.

As another approach to adjusting the opening force of the regulator 20, the overall size of the valve element 38 may be adjusted to change the total area of overlap between the valve element 38 and the seat 36 to thereby establish the desired level of the magnetic attraction between those components.

Because the valve element 38 is formed of bendable material, such as the elastomeric material described above, or a ferromagnetic grade of stainless steel as described hereafter, there is an intrinsic spring force within the valve element. The spring force works in conjunction with the magnetic attraction between the valve element 38 and seat 36 to urge the valve element into the closed position. Accordingly, changing the size of the valve element 38 will change the intrinsic spring force in the valve element, which changes the opening force of the regulator.

As an alternative construction of the present regulator, the valve element 38 could be a magnetized metal member and the seat 36 could be formed of elastomeric material having an amount of ferromagnetic material embedded within it for generating sufficient magnetic attraction to close the valve element 38.

In the preferred embodiment, the valve element 38 was described as being magnetized and the seat was described as being ferromagnetic (particularly, ferromagnetic grade stainless steel) It is contemplated, however, that as an alternative, the seat 36 could be magnetized and the valve element 38 could be formed of ferromagnetic material.

Figure 3:
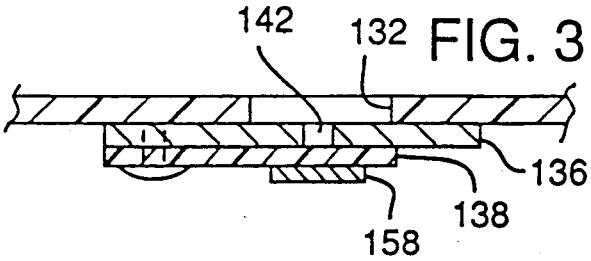
FIG. 3 is a cross-sectional view of an alternative embodiment of a regulator formed in accordance with this invention.

FIG. 3 depicts an alternative embodiment of a regulator mounted near a reservoir vent 132. The seat 136 is formed of ferromagnetic material, such as ferromagnetic grade stainless steel (or elastomeric material having embedded ferromagnetic material), and the valve element 138 includes an attached cylindrical magnetic slug 158. The remaining part of the valve element 138 may be formed of any suitable flexible material such as plastic. The magnetic slug 158 is attached so that the magnetic attraction between the slug 158 and the seat 136 is greatest around the port 142 formed in the seat 136.

Figure 4:
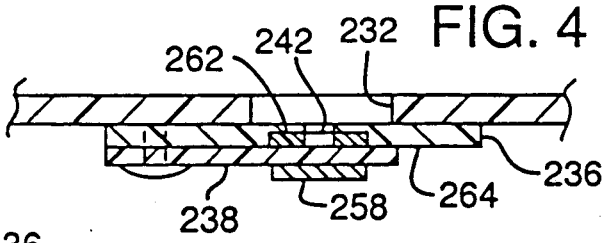
FIG. 4 is a cross-sectional view of another alternative embodiment of a regulator formed in accordance with this invention.

FIG. 4 depicts another embodiment of the regulator formed in accordance with the present invention. In particular, the seat 236 is formed of plastic or other non-ferromagnetic material and includes an annulus 262 of ferromagnetic material embedded within the inner surface 264 of the seat 236 to surround the port 242 formed in the seat. The valve element 238 is formed in a manner similar to the valve element 138 described with respect to FIG. 3. Accordingly, the magnetic slug 258 that is attached to the valve element 238 is magnetically attracted to the ferromagnetic annulus 62 embedded within the seat 236.

It is contemplated that in the embodiment shown in FIG. 4, the slug 258 could be formed of ferromagnetic material and the annulus 262 could be magnetized. Moreover, both the slug 258 and the annulus 236 could be magnetized with their respective poles suitably oriented for generating the magnetic attraction necessary for urging the valve element 238 into the closed position. In this regard, it is noteworthy that any embodiment of the present invention could be configured in the manner such that both the valve element and the seat are magnetized.

Figure 5:
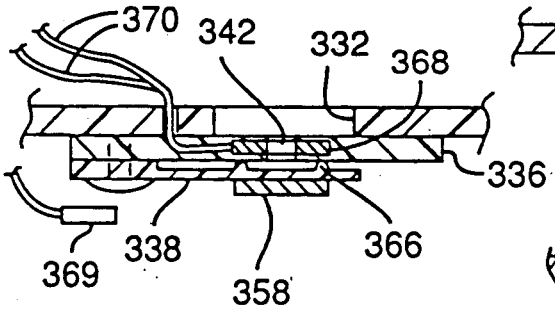
FIG. 5 is a cross-sectional view of another alternative embodiment of a regulator formed in accordance with this invention.

FIG. 5 depicts another alternative embodiment of the present invention that includes a deformable sealing feature 366 for sealing the port 342 formed in the seat 336 whenever the valve element 338 is closed. In the embodiment shown in FIG. 5, the valve element 338 is formed of elastomeric material and the sealing feature 366 comprises an annular-shaped protrusion in the portion of the valve element surface that is near the port 342. The sealing feature 366 is shaped to surround the port 342 formed in the seat 336. Whenever the valve element 338 is closed, the sealing feature 366 is deformed between the seat and the valve element. The deformed sealing feature 366 ensures that no air will leak from ambient into the reservoir 22 whenever the valve element 338 is in the closed position. It is contemplated that, as an alternative construction, the sealing feature 366 could be attached to the seat 436.

As noted above, the seat or the valve element may be magnetized. It is contemplated that the magnetization may be provided by an electromagnet. For example, the seat 336 of the regulator embodiment shown in FIG. 5 is formed of elastomeric material and include an embedded electromagnet 368 having leads 370 emanating from the seat. The leads 370 pass through the pen body and connect with a switchable current source. The electromagnet 368 is activated to attract a ferromagnetic slug 358 attached to the valve element 338. It can be appreciated that as an alternative construction, the electromagnet could be attached to the valve element.

The use of an electromagnet 368 provides a simple method for adjusting the opening force of the regulator. Specifically, the current applied to the electromagnet 368 may be varied to adjust the magnetic attraction between the seat 336 and valve element 338 to that necessary to ensure that the valve element 338 remains closed while the underpressure in the reservoir remains within the underpressure operating range.

For certain applications, the slug 358 may be a magnet (or the valve element 338 may be formed of magnetic material) with poles arranged so that the slug is magnetically attracted to the seat when the electromagnet is off and repelled from the seat when the electromagnet is on. By adjusting the current in the electromagnet, it is possible to substantially negate the spring force in the valve element so that the regulator, if desired, may be precisely adjusted to open as a result of minute incremental changes in the reservoir underpressure.

The electromagnetic seat and magnetic valve element arrangement just described may be combined with a conventional pressure sensor 369 (FIG. 5) to provide active control of the regulator opening force. In this regard, the sensor 369 is disposed within the fluid reservoir to provide a continuous indication of the fluid pressure therein. The output of the sensor may be applied to a conventional feedback control loop (not shown) for controlling the current applied to the electromagnet, hence controlling the opening force of the regulator in active response to underpressure changes.

Figure 6:
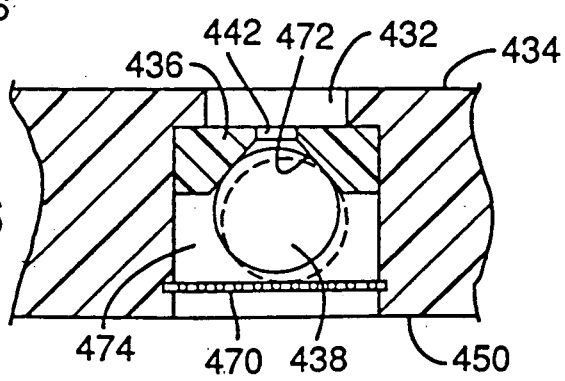
FIG. 6 is a cross-sectional view of another alternative embodiment of a regulator formed in accordance with this invention.

FIG. 6 depicts an alternative embodiment of the present invention wherein the valve element 438 of the regulator is shaped as a sphere and wherein the seat 436 includes a recess 472 into which the sphere-shaped valve element 438 moves to close the port 442. More particularly, the top 434 of the pen body includes a vent 432 that opens into a chamber 474 that is formed in the inner surface 450 of the reservoir top 434. The seat 436 is a generally annular member that is mounted at the junction of the vent 432 and the chamber 474. The seat 436 includes a central port 442 that is in fluid communication with the vent 432. The recess 472 that is formed in the seat 436 defines an inverted truncated cone shape. The recess 472 is in fluid communication with the port 442.

The sphere-shaped valve 438 is secured within the chamber 474 by a screen 470 that extends across the chamber opening near the inner surface 450 of the reservoir top 434. Magnetic attraction between the seat 436 and sphere-shaped valve element 438 urges the valve element 438 into the recess 472, thereby sealing the port 442. As the underpressure within the reservoir rises above the maximum underpressure level the resultant underpressure force counteracts the magnetic attraction and moves the valve element 438 slightly out of the recess 472 (dashed lines in FIG. 6) so that ambient air may pass through the port and recess and into the reservoir, thereby lowering the underpressure in the reservoir.

In the embodiment shown in FIG. 6, either the seat 436 or the valve element 438 may be magnetized. Moreover, either the seat or the valve element, or both, may be formed of elastomeric material to enhance the seal of the valve element 438 against the seat 436.

Figure 7:
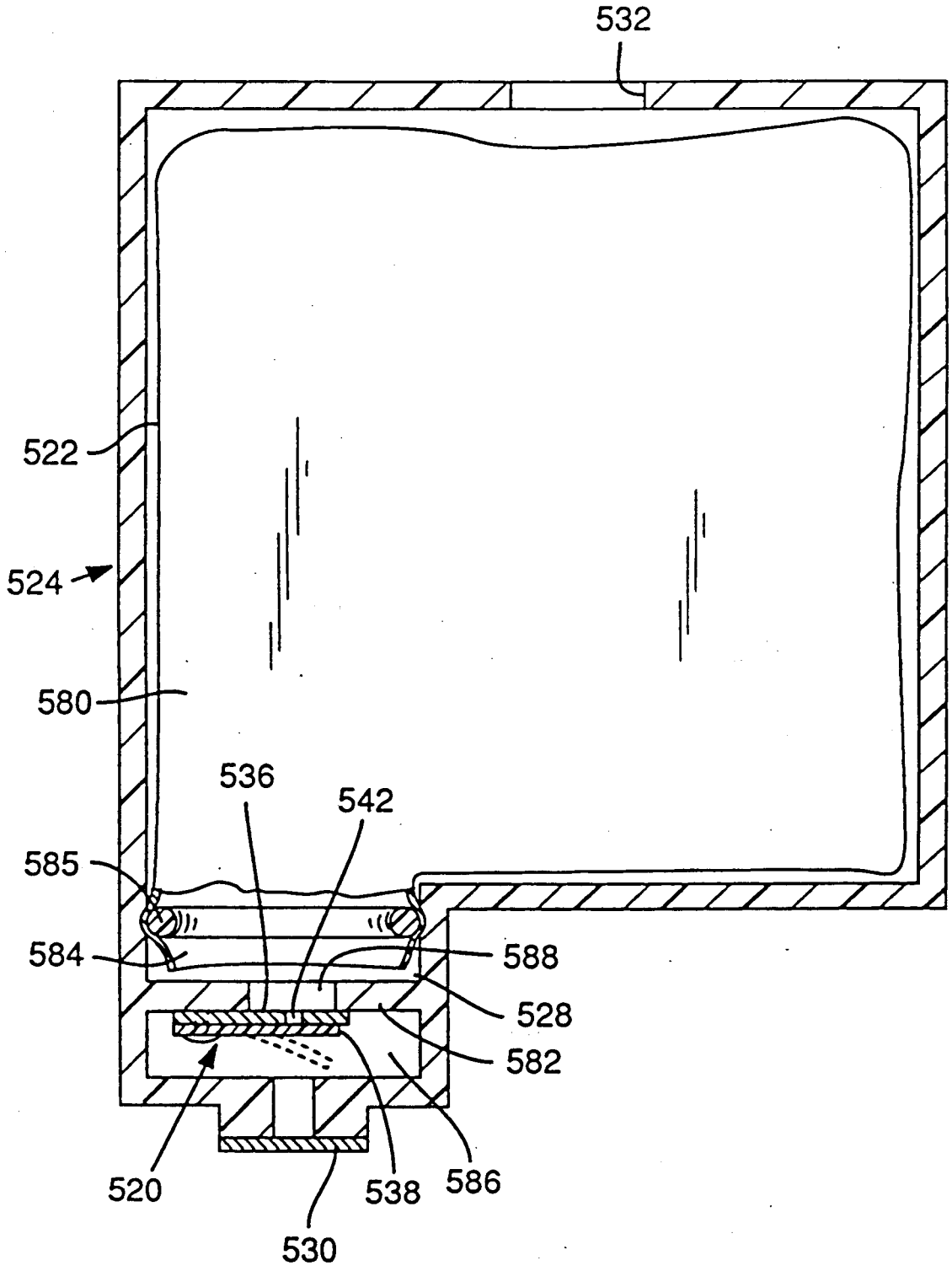
FIG. 7 is a cross-sectional view of an ink-jet pen showing an alternative arrangement of a regulator formed in accordance with this invention.

The regulator of the present invention may be used with any number of pen configurations and its use is not limited to pens having print heads that are in direct fluid communication with the ink reservoir. For example, FIG. 7 depicts a regulator 520 that is mounted for use with an ink-jet pen 524 wherein the ink is carried in a collapsible bladder 580 that is contained within the reservoir 522. The exterior of the bladder is exposed to ambient pressure via vent 532. The bladder 580 has an opening 584 that is secured near the well 528, such as by mounting ring 585, so that ink within the bladder 580 flows into the well 528. A divider 582 is formed in the well 528 to extend between the bladder opening 584 and the print head 530. The divider 582 defines a cavity 586 immediately above the print head 530. An aperture 588 permits ink to flow from the bladder into the cavity 586.

The regulator 520 functions to permit an underpressure to be established within the cavity 586 so that ink in the cavity will not leak through an inactive print head 530. In this regard, the regulator 520 may be formed in accordance with any of the embodiments described above and includes a seat 536 and valve element 538. It is noteworthy, however, that in establishing the opening force of the valve element 538, it is necessary to take into consideration the hydrostatic pressure of the ink acting on the valve element (through port 542).

While the present invention has been described in relation to a preferred embodiment and alternatives, it is to be understood that other alterations, substitutions of equivalents, or other changes may be made without departing from the spirit and scope of the invention described in the claims.

We claim:

1. A regulator for an ink-jet pen that has a print head for expelling ink from a fluid volume, the regulator comprising:

a seat mounted to the pen, the seat having a port formed therethrough;

a valve element mounted adjacent to the seat for movement relative to the seat; and control means for magnetically urging together the seat and the valve element to close the port, and for separating the seat and the valve element to open the port whenever the pressure seat and the valve element to open the port whenever the pressure in the fluid volume is at a predetermined pressure, the valve element being constructed to generated upon separating from the seat a spring force that urges the valve element toward the seat.

2. The regulator of claim 1 wherein the control means includes a ferromagnetic part of the seat and a magnetized part of the valve element.

3. The regulator of claim 1 wherein the control means includes a ferromagnetic part of the valve element and a magnetized part of the seat.

4. The regulator of claim 3 wherein the magnetized part of the seat is an electromagnet.

5. The regulator of claim 1 wherein the control means includes a magnetized part of the seat and a magnetized part of the valve element.

6. The regulator of claim 5 wherein the control means includes adjustment means for adjusting the strength of the magnetic field of the magnetized part of the seat in response to changes in the pressure in the fluid volume.

7. The regulator of claim 6 wherein the adjustment means includes a pressure sensor disposed within the fluid volume.

8. The regulator of claim 1 wherein part of the valve element is formed of deformable material.

9. The regulator of claim 8 wherein the deformable part of the valve element is configured to define a sealing feature that is deformed between the seat and valve element to seal the port when the port is closed.

10. The regulator of claim 8 wherein the valve element flexes upon separating from the seat.

11. The regulator of claim 1 wherein part of the seat is formed of deformable material.

12. The regulator of claim 11 wherein the deformable part of the seat is configured to define a sealing feature that is deformed between the seat and valve element to seal the port when the port is closed.

13. The regulator of claim 1 wherein the control means includes a spring as part of the valve element, the spring being configured for urging together the seat and the valve element to close the port.

14. The regulator of claim 1 wherein the valve element comprises a flexible flat spring.

15. A regulator for an ink-jet pen that has a print head for expelling ink from a fluid volume, the regulator comprising:

a vent for venting the fluid volume to ambient;

a flexible valve element mounted adjacent to the vent for movement relative thereto; and control means for urging the valve element into a position for closing the vent, and for moving the valve element into a position for opening the vent whenever the pressure in the fluid volume is at a predetermined pressure.

16. The regulator of claim 15 wherein the control means includes a seat mounted near the vent and having a port formed therethrough in fluid communication with the vent, the control means magnetically urging together the seat and the valve element to close the port and vent.

17. The regulator of claim 16 wherein the control means includes a ferromagnetic part of the valve element and a magnetized part of the seat.

18. The regulator of claim 17 wherein the magnetized part of the seat is an electromagnet.

19. The regulator of claim 16 wherein the control means includes a magnetized part of the seat and a magnetized part of the valve element.

20. The regulator of claim 16 wherein part of the valve element is formed of deformable material.

21. The regulator of claim 20 wherein the deformable part of the valve element is configured to define a sealing feature that deforms to seal the port when the port is closed.

22. The regulator of claim 16 wherein part of the seat is formed of deformable material.

23. The regulator of claim 22 wherein the deformable part of the seat is configured to define a sealing feature that deforms to seal the port when the port is closed.

24. The regulator of claim 16 wherein the control means includes a ferromagnetic part of the seat and a magnetized part of the valve element.

25. The regulator of claim 24 wherein the magnetized part of the valve element is an electromagnet.

26. The regulator of claim 15 wherein the control means includes a spring as part of the valve element, the spring configured for urging the valve element into the position for closing the vent.

27. The regulator of claim 15 wherein the valve element comprises a flat spring.

28. A regulator apparatus for an ink-jet pen comprising:

a pen body;

a deformable seat mounted to the pen body, the seat having a port formed therethrough;

a spherical valve element mounted adjacent to the seat for movement relative to the seat; and control means for magnetically urging together the seat and the valve element to deform the seat and close the port, and for separating the seat and the valve element to open the port whenever the pressure in the fluid volume reaches a predetermined pressure.

29. A regulator apparatus for an ink-jet pen comprising:

a pen body;

a seat mounted to the pen body, the seat having a port formed therethrough;

a deformable spherical valve element mounted adjacent to the seat for movement relative to the seat; and control means for magnetically urging together the seat and the valve element to close the port, and for separating the seat and the valve element to open the port whenever the pressure in the fluid volume reaches a predetermined pressure.

* * * * *